US009057574B2

(12) United States Patent
McClave

(10) Patent No.: US 9,057,574 B2
(45) Date of Patent: Jun. 16, 2015

(54) THUMB SAFETY FOR MODEL 1911 HANDGUN

(71) Applicant: RA BRANDS, L.L.C., Madison, NC (US)

(72) Inventor: Peter McClave, West Winfield, NY (US)

(73) Assignee: RA Brands, L.L.C., Madison, NC (US)

( * ) Notice: Subject to any disclaimer, the term of this patent is extended or adjusted under 35 U.S.C. 154(b) by 101 days.

(21) Appl. No.: 13/780,083

(22) Filed: Feb. 28, 2013

(65) Prior Publication Data

US 2013/0333262 A1 Dec. 19, 2013

Related U.S. Application Data

(60) Provisional application No. 61/659,469, filed on Jun. 14, 2012.

(51) Int. Cl.
*F41A 17/00* (2006.01)
*F41A 17/56* (2006.01)
*F41A 17/42* (2006.01)

(52) U.S. Cl.
CPC ..... *F41A 17/56* (2013.01); *F41A 17/00* (2013.01); *F41A 17/42* (2013.01)

(58) Field of Classification Search
CPC ..... F41A 17/00; F41A 17/42; F41A 17/56
USPC ..... 42/70.01, 70.04, 70.05, 70.06, 70.08
See application file for complete search history.

(56) References Cited

U.S. PATENT DOCUMENTS 1,352,267 A * 9/1920 Hubbell ..... 89/138
2,529,359 A 11/1950 Stevens
3,159,080 A 12/1964 Freed
3,492,748 A * 2/1970 Swenson ..... 42/70.01
3,750,531 A 8/1973 Angell et al.
4,173,169 A 11/1979 Yates et al.
4,176,584 A 12/1979 Thomas, Jr., deceased et al.
4,208,947 A 6/1980 Hillberg
4,414,769 A * 11/1983 Mueschke ..... 42/70.01

(Continued)

FOREIGN PATENT DOCUMENTS

DE 366219 11/1923
DE 2731893 A1 2/1978

OTHER PUBLICATIONS

Chiappa 1911-22. <http://www.ar15.com/archive/topic.html?b=5&f=50&t=98027>. ar15.com forum post by username "Heyday". Jul. 16, 2010.*

(Continued)

*Primary Examiner* — Gabriel Klein
(74) *Attorney, Agent, or Firm* — Womble Carlyle Sandridge & Rice, LLP

(57) ABSTRACT

A pistol thumb safety that is capable of being coupled to a frame of a pistol, the thumb safety including a safety body adapted to be movably mounted to the frame so that the body is movable between firing and safe positions. The safety body includes an outer side surface, an inner side surface, and a top portion. A blocking feature is formed along the top portion of the safety body, wherein the blocking portion engages the slide of the pistol when the safety body is in its safe position. As a result, the slide is movable along the safety body for clearing the chamber of the pistol while the safety body is maintained in its safe position.

19 Claims, 10 Drawing Sheets

(56) References Cited

U.S. PATENT DOCUMENTS

| | | | | |
|---|---|---|---|---|
| 4,589,327 | A | 5/1986 | Smith | |
| 4,742,634 | A | 5/1988 | Swenson | |
| 5,068,969 | A | 12/1991 | Siebert | |
| 5,090,147 | A | 2/1992 | Pastor | |
| 5,182,959 | A | 2/1993 | McCoan et al. | |
| 5,212,327 | A | 5/1993 | Schuemann | |
| 5,267,407 | A | 12/1993 | Bornancini | |
| 5,272,828 | A | 12/1993 | Petrick et al. | |
| 5,301,448 | A | 4/1994 | Petrick et al. | |
| 5,421,264 | A | 6/1995 | Petrick | |
| 5,459,957 | A | 10/1995 | Winer | |
| 5,758,524 | A | 6/1998 | Yu | |
| 5,760,328 | A | 6/1998 | Robbins | |
| 5,799,434 | A | 9/1998 | Krieger et al. | |
| 5,815,973 | A | 10/1998 | Hochstrate | |
| 5,903,994 | A * | 5/1999 | Tange | 42/70.01 |
| 5,955,696 | A | 9/1999 | Meller | |
| 6,000,162 | A | 12/1999 | Hochstrate | |
| 6,269,576 | B1 | 8/2001 | Williams | |
| 6,283,006 | B1 | 9/2001 | Szabo et al. | |
| 6,341,442 | B1 | 1/2002 | Szabo et al. | |
| 6,345,463 | B1 | 2/2002 | Baer, Sr. | |
| 6,374,526 | B1 | 4/2002 | Mochak | |
| 6,381,892 | B1 | 5/2002 | Szabo et al. | |
| 6,405,631 | B1 | 6/2002 | Milek | |
| 6,412,207 | B1 | 7/2002 | Crye et al. | |
| 6,415,702 | B1 | 7/2002 | Szabo et al. | |
| 6,442,880 | B1 | 9/2002 | Allan | |
| 6,477,802 | B2 | 11/2002 | Baer, Sr. | |
| 6,481,140 | B1 | 11/2002 | Marshall | |
| 6,510,639 | B2 | 1/2003 | McMoore | |
| 6,557,288 | B2 | 5/2003 | Szabo | |
| 6,691,445 | B2 | 2/2004 | Williams | |
| 6,705,035 | B2 | 3/2004 | Beretta | |
| 6,769,208 | B2 | 8/2004 | Beretta | |
| 6,839,999 | B2 | 1/2005 | Beretta | |
| 6,851,212 | B2 | 2/2005 | Szabo | |
| 6,941,692 | B1 | 9/2005 | Krinke et al. | |
| 7,047,686 | B2 | 5/2006 | Zimmermann | |
| 7,131,228 | B2 | 11/2006 | Hochstrate et al. | |
| 7,213,359 | B2 | 5/2007 | Beretta | |
| 7,318,294 | B2 | 1/2008 | Zimmermann | |
| 7,530,191 | B2 | 5/2009 | Szabo | |
| 7,654,187 | B2 | 2/2010 | Hochstrate et al. | |
| 7,661,218 | B2 | 2/2010 | Pikielny | |
| 7,673,553 | B2 | 3/2010 | Lippard | |
| 7,698,845 | B2 | 4/2010 | Hochstrate et al. | |
| 7,707,923 | B2 | 5/2010 | Beretta | |
| 7,775,150 | B2 | 8/2010 | Hochstrate et al. | |
| 7,819,051 | B1 | 10/2010 | Beckmann et al. | |
| 7,861,640 | B2 | 1/2011 | Lippard | |
| 7,938,055 | B2 | 5/2011 | Hochstrate et al. | |
| 7,966,761 | B1 | 6/2011 | Kuczunko et al. | |
| 8,047,119 | B2 | 11/2011 | Hochstrate | |
| 8,051,595 | B2 | 11/2011 | Hochstrate et al. | |
| 8,127,481 | B2 | 3/2012 | Rozum et al. | |
| 8,333,028 | B1 * | 12/2012 | Karfiol et al. | 42/70.01 |
| 2002/0115127 | A1 | 8/2002 | Szabo et al. | |
| 2004/0020095 | A1 | 2/2004 | Beretta | |
| 2005/0011100 | A1 | 1/2005 | Fluhr | |
| 2007/0051236 | A1 | 3/2007 | Groves et al. | |
| 2007/0180984 | A1 | 8/2007 | Huther | |
| 2008/0039962 | A1 | 2/2008 | McRae | |
| 2009/0178325 | A1 | 7/2009 | Veilleux | |
| 2010/0024274 | A1 | 2/2010 | Lippard | |
| 2010/0170131 | A1 | 7/2010 | Zukowski | |
| 2010/0170132 | A1 | 7/2010 | Zukowski | |
| 2010/0170138 | A1 | 7/2010 | Zukowski | |
| 2010/0300277 | A1 | 12/2010 | Hochstrate et al. | |
| 2011/0079137 | A1 | 4/2011 | Audibert et al. | |
| 2011/0259183 | A1 | 10/2011 | Compton et al. | |
| 2011/0289811 | A1 | 12/2011 | Gentilini et al. | |
| 2012/0005933 | A1 | 1/2012 | Andreis | |
| 2012/0023801 | A1 | 2/2012 | Rozum et al. | |
| 2013/0152444 | A1 * | 6/2013 | Tatum | 42/70.05 |

OTHER PUBLICATIONS

Defensive Carry. <http://www.defensivecarry.com/forum/defensive-carry-guns/35170-cocked-locked-1911-dangerous-4.html>.

DefensiveCarry.com forum post #53 by username "OD". Nov. 8, 2007.*

International Search Report and Written Opinion dated Sep. 18, 2013 for PCT/US2013/045344 filed Jun. 12, 2013; 14 pages.

SIG Sauer P238 Owners Manual, 1200901 Rev 04, 63 pages, Exeter, New Hampshire.

Chambering with TS Engaged; 1911Forum.com, Jun. 17, 2009; http://forums.1911forum.com/showthread.php?t=236890.

Patrick Sweeney; Novak Custom Next; Firing Line Report; Sep. 24, 2010; http://www.handgunsmag.com/2010/09/24/featuredhandguns_hg_novacustom_201009/.

Bevel Bottom of Slide; 1911Forum.com; Mar. 4, 2011; http://forums.1911forum.com/showthread.php?t=306934.

Novaks Next 1911; Novak Designs, Inc.; Aug. 29, 2010; http://www.novaksights.com/customguns/1911/next.html.

2012 Shot Show—4. Kimber; M1911.Org E-zine; Jan. 16, 2012; http://ezine.m1911.org./showthread.php?t=120.

* cited by examiner

THUMB SAFETY FOR MODEL 1911 HANDGUN

CROSS REFERENCE TO RELATED APPLICATION

The present Patent Application is a formalization of previously filed, U.S. Provisional Patent Application Ser. No. 61/659,469, filed Jun. 14, 2012. This Patent Application claims the benefit of the filing date of this cited Provisional Patent Application according to the statutes and rules governing provisional patent applications, particularly 35 U.S.C. §119(a)(i) and 37 C.F.R. §1.78(a)(4) and (a)(5). The specification and drawings of the Provisional Patent Application referenced above are specifically incorporated herein by reference as if set forth in their entirety.

FIELD OF THE INVENTION

The present invention generally is directed to safety mechanisms for firearms, and in particular to an improved thumb safety for a Model 1911-type handgun that enables a firearm to be placed in a safe condition while still enabling operation of the slide of the firearm.

BACKGROUND OF THE INVENTION

The Model 1911 handgun is one of the most well known and widely used handguns. Despite its popularity and long-standing use, there still exist drawbacks with this firearm. In particular, as a safety feature, most Model 1911's have a thumb safety located near the grip of the firearm adjacent the rear end thereof. The thumb safety generally is rotatable into a position wherein it will block the operation of the hammer and sear of the firearm. However, when the thumb safety is moved to its safe or engaging position, it also engages a notch formed in the slide so as to block movement of the slide as a further means of preventing inadvertent discharge since the hammer of the firearm typically must be in an extended, cocked position for use of the thumb safety. However, when the firearm has not been fully discharged but must be unloaded, since the slide cannot be operated with the thumb safety in its engaged, safe position, the chamber of the firearm also cannot be emptied to fully and properly unload the weapon unless the thumb safety is taken off of its safe position to allow operation of the slide.

Attempts have been made to try to machine the slide of Model 1911's to elongate the notch wherein the thumb safety engages the slide, to enable some movement of the slide and thus allow access to and clearing of the chamber. However, such modifications generally require a significant reconfiguration or replacement of the slide to provide for an elongated slot, which potentially adversely affects the appearance of the firearm and can be costly. In addition, the elongation of the slotted notch for the thumb safety can create a risk of the thumb safety being over-rotated and thus moved past or out of engagement with the sear, or otherwise being dislodged from its blocking engagement with the hammer and sear during movement of the slide. As a result, given that the hammer of the firearm generally must be in a cocked position upon engagement of the thumb safety, this potentially further can lead to inadvertent discharge of the firearm while the user attempts to clear the chamber.

Accordingly, it can be seen that a need exists for an improved thumb safety mechanism that addresses the foregoing and other related and unrelated problems in the art.

SUMMARY OF THE INVENTION

Briefly described, the present invention generally relates to a thumb safety for a Model 1911-type firearm adapted to engage and prevent operation of the sear and hammer of the firearm when in its engaged, safe position, while still enabling operation of the slide of the firearm. The thumb safety generally includes a body having an engagement tab or member projecting forwardly along an outer side surface thereof. A post or pivot pin is mounted to an inner side surface of the body, projecting inwardly, the post being adapted to engage the frame of a handgun. The post thus enables the pivoting movement of the thumb safety between a first, non-engaging or "fire" position and the second, engaging or "safe" position. Additionally, a stub shaft is mounted along a lower portion of the inner side surface of the thumb safety body, projecting inwardly therefrom. The stub shaft generally includes a series of engagement surfaces or features formed along its distal end that are adapted to engage the sear of the firearm as the thumb safety is rotated to its engaging or "safe" position. With the thumb safety in its engaging position, the sear is locked in place in a position engaging the hammer and blocking forward movement of the hammer to prevent discharge of the firearm.

In addition, a blocking feature is formed along an upper surface or portion of the inner side surface of the thumb safety body. The blocking feature generally can comprise an upwardly sloping forward surface that forms a ridge, hump or similar cam projection formed along the upper portion of the inner side surface, spaced inwardly from the outer side surface of the body of the thumb safety. The blocking feature will engage a bottom edge of the slide of the firearm as the thumb safety is rotated to its engaging or safe position, which prevents over-travel or over-rotation of the thumb safety with respect to the sear of the firearm. The cam projection thus defines a cam surface or profile over which the slide can move while engaging the thumb safety and preventing unintended movement or dislocation of the thumb safety from its safe position locking the sear in its blocking position with respect to the hammer. As a result, once the thumb safety has been placed in its safe position, the slide of the firearm can be operated to clear the chamber of the firearm without having to first move the thumb safety off its safe position and into its non-engaging position. The thumb safety also can include another thumb safety body and/or tab on the opposite side of the firearm, linked to and operable with the thumb safety to enable ambidextrous operation and engagement of the thumb safety of the present invention. The design of the present thumb safety further enables its use as a replacement for an existing thumb safety on a Model 1911-type firearm, without requiring reconfiguration or reconstruction of the slide or other elements of the firearm.

Various features, objects and advantages of the present invention will become apparent to those skilled in the art upon a review of the following detailed description, when taken in conjunction with the accompanying drawings.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Figure 1:
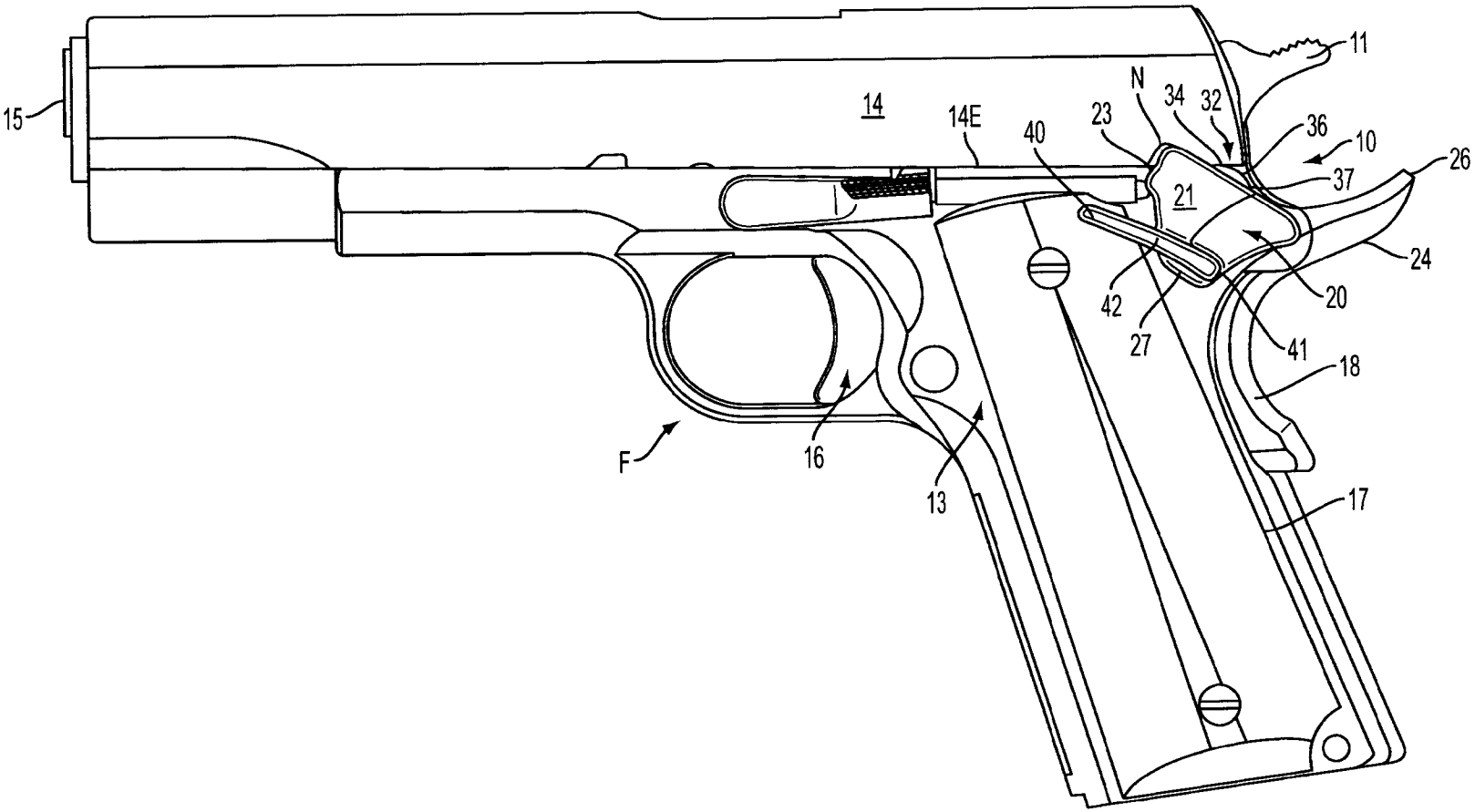
FIG. 1 is a side elevational view of the left side of a firearm including a thumb safety according to the principles of the present invention.
Figure 5A:
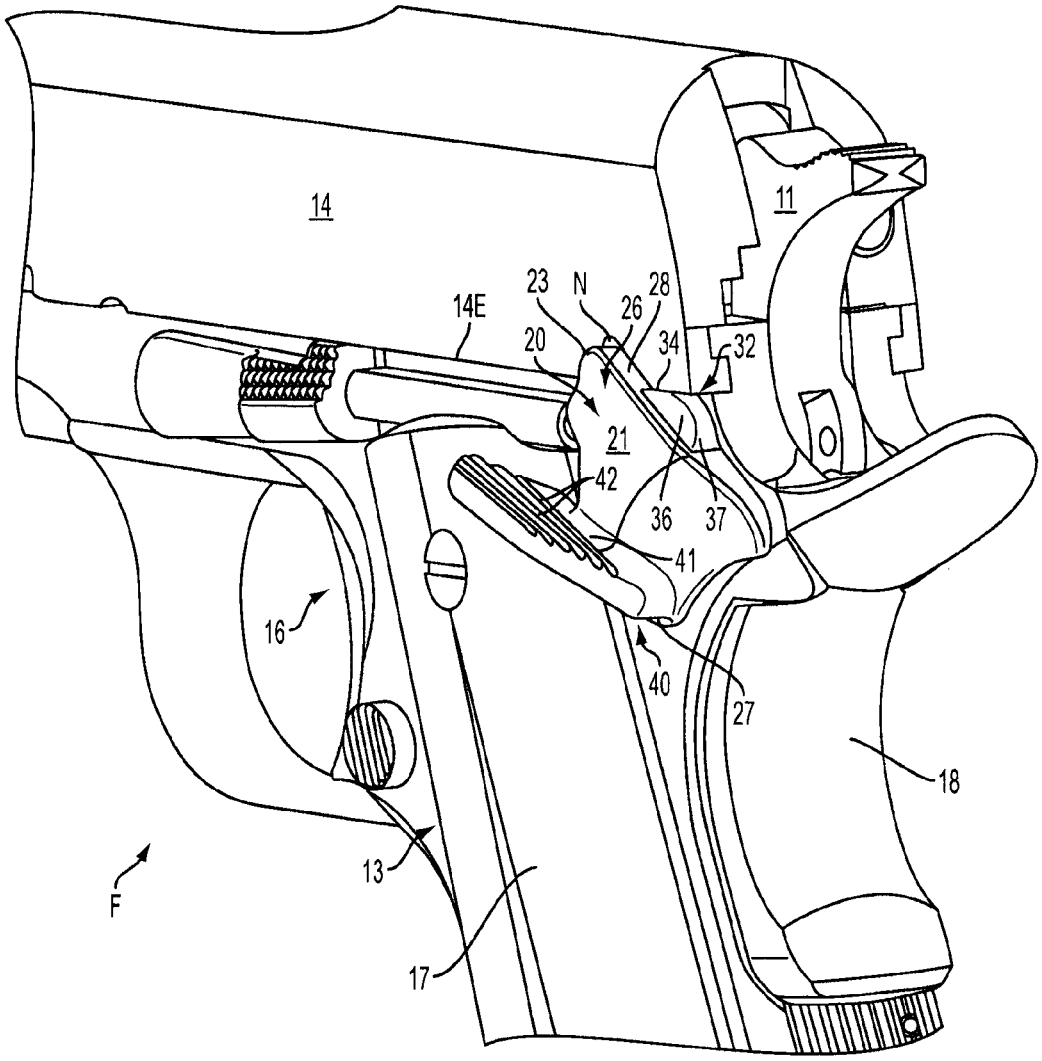
FIGS. 5A-5B are perspective illustrations of the engagement of the blocking feature of the thumb safety of FIGS. 1-4 with the bottom edge of the firearm slide.
Figure 5B:
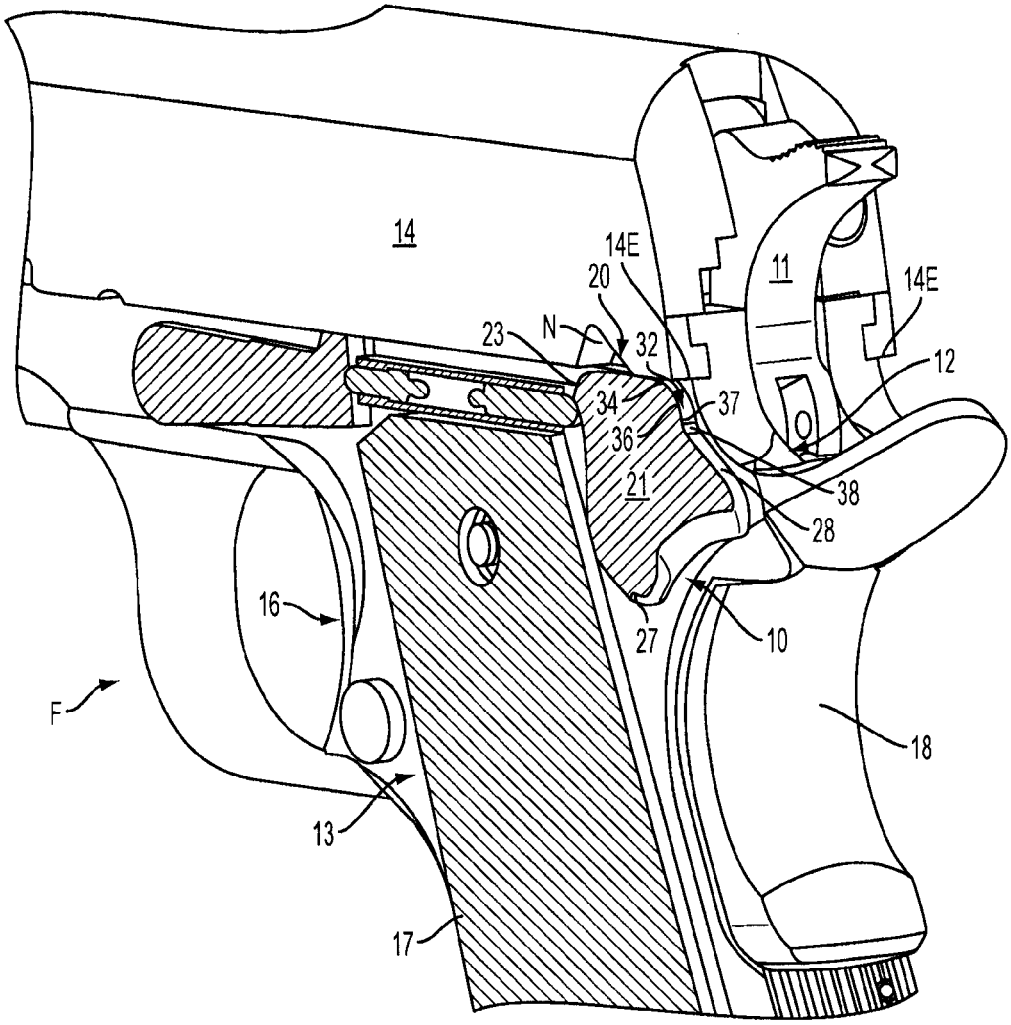
Figure 6A:
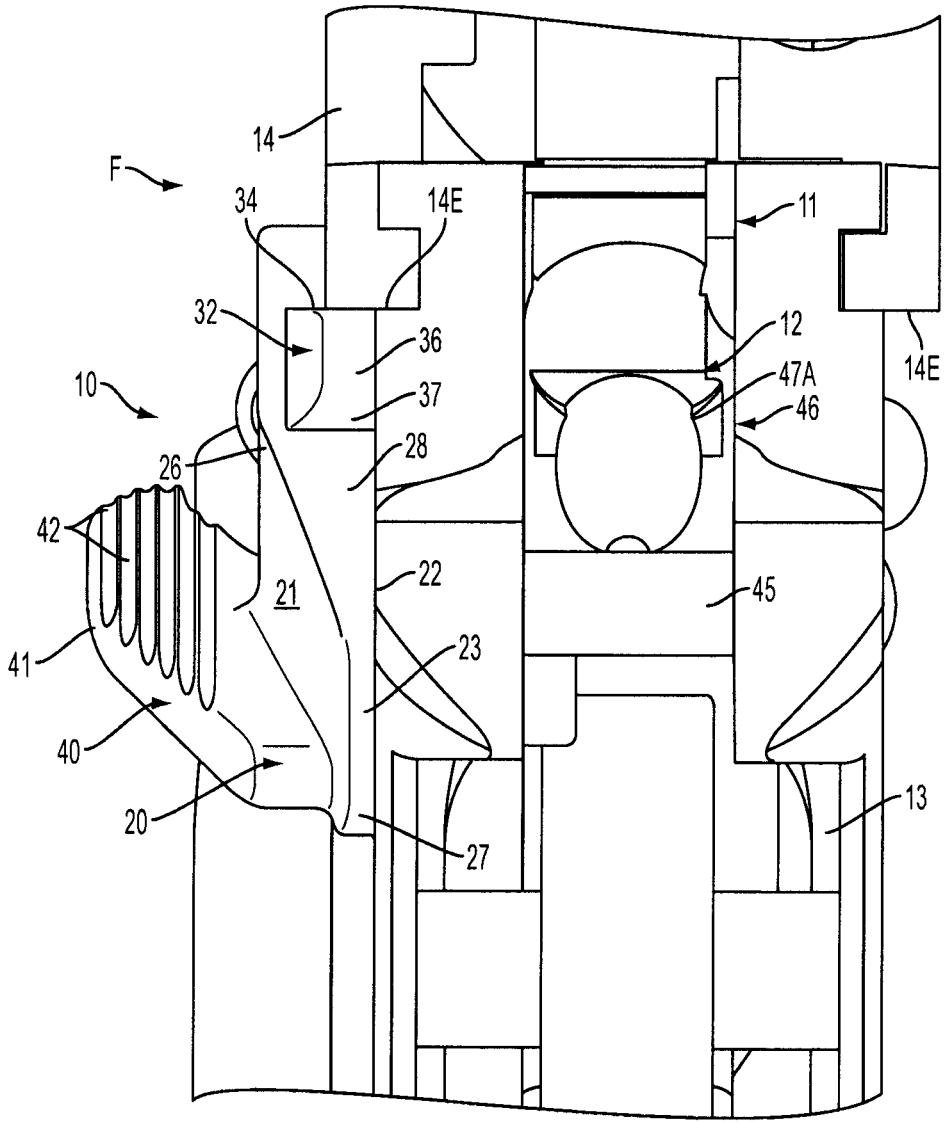
FIGS. 6A-6B are end views, taken in partial cross-section, of the firearm frame showing the engagement of the blocking feature of the thumb safety of the present invention with the slide of the firearm.
Figure 6B:
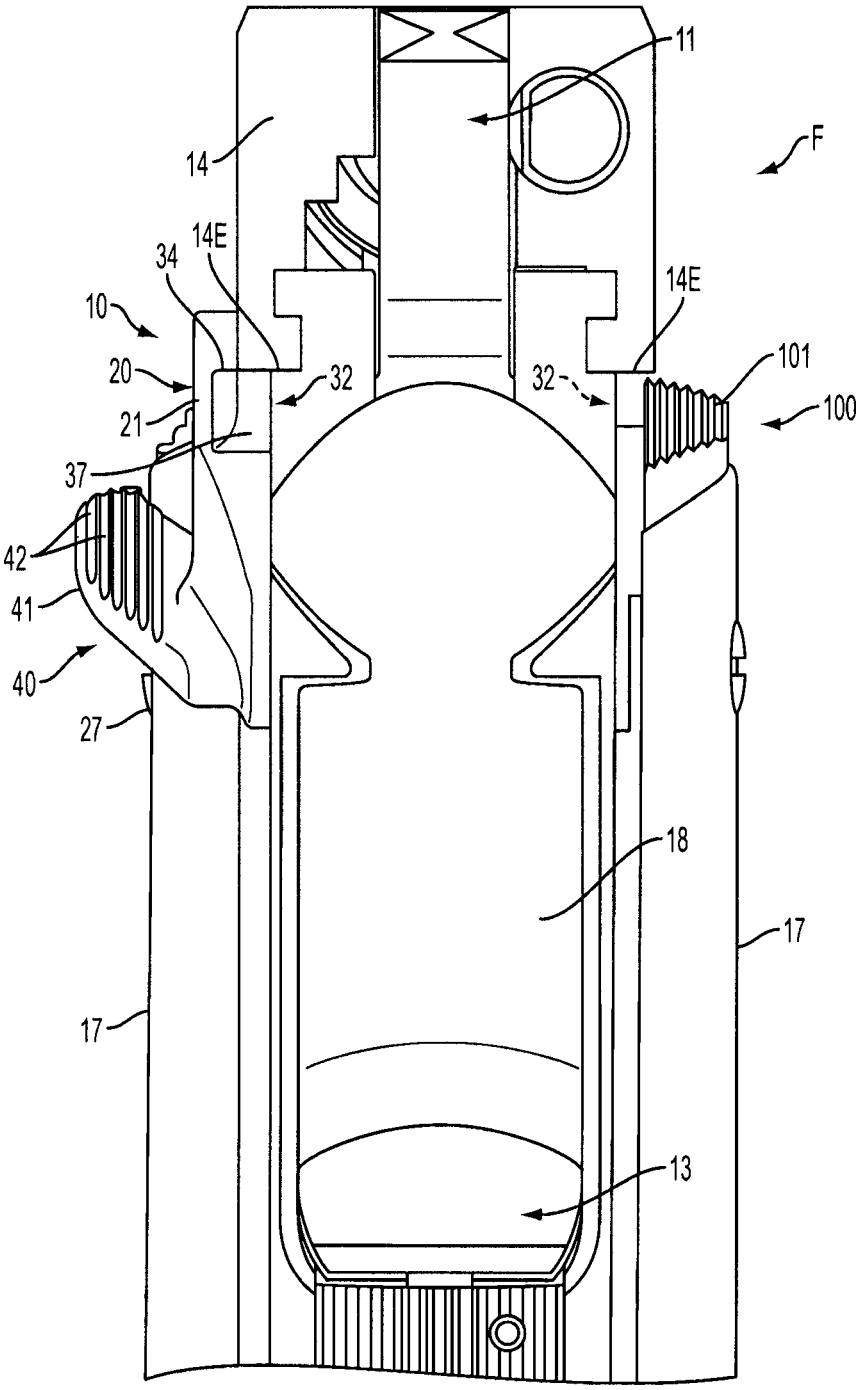
Figure 7:
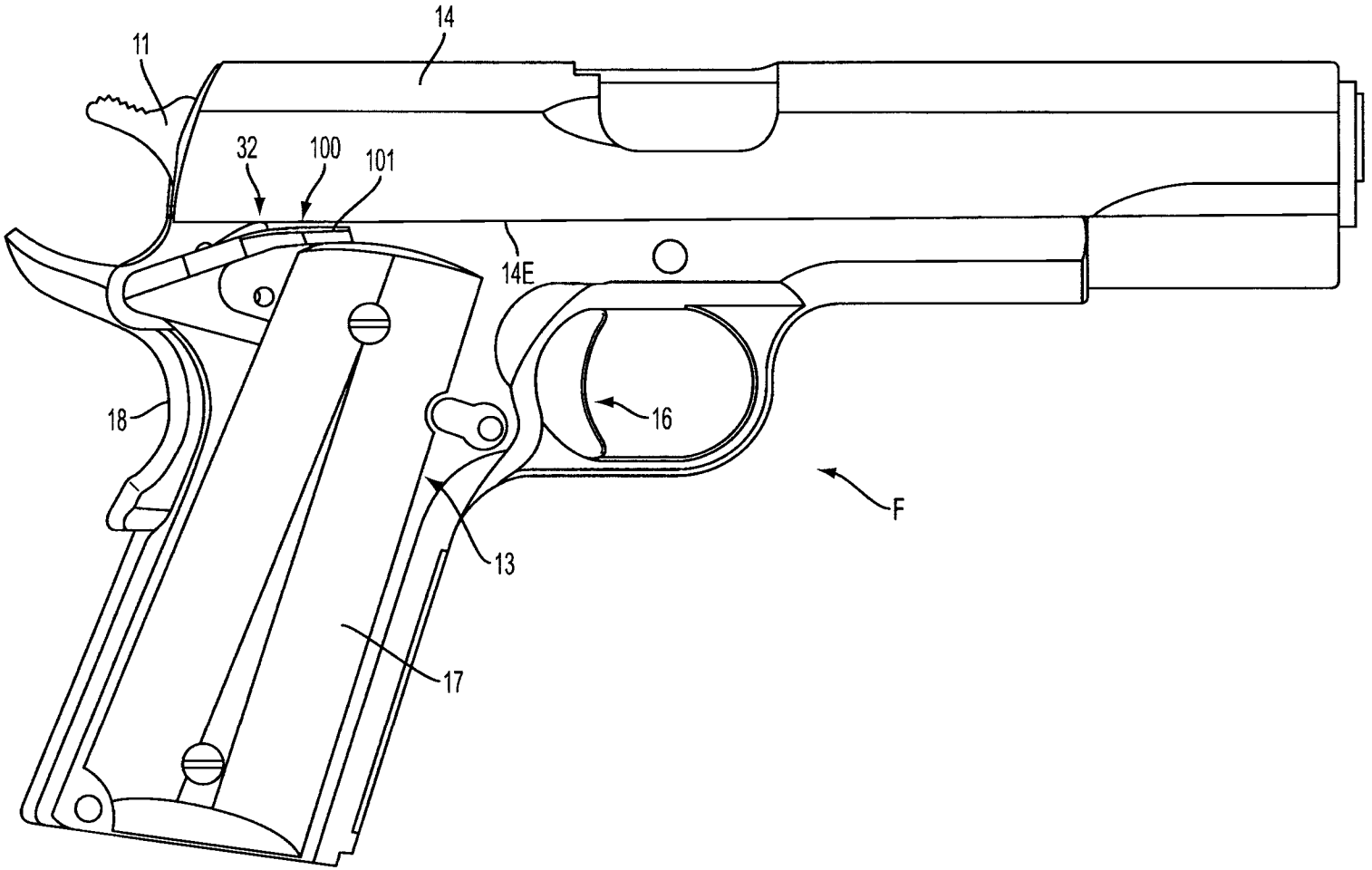
FIG. 7 is a side elevational view of the right side of a firearm including and a thumb safety body mounted thereal-ong for ambidextrous operation of the thumb safety according to the principles of the present invention.

Referring now to the drawings in which like numerals indicate like parts throughout the several views, FIGS. 1-6B generally illustrate the thumb safety 10 for use on a Model 1911-type firearm, indicated at "F," in FIGS. 1 and 7 for blocking or otherwise preventing operation of the hammer 11 and sear 12 (FIGS. 6A-6B) of the firearm, and including ambidextrous engagement and operation thereof. As shown in FIGS. 1 and 7, the firearm F generally also will include a frame or receiver 13, with a slide 14 movable thereon, a barrel 15, a fire control or trigger 16, a grip 17 below the slide 14, and a trigger safety 18. The thumb safety 10 generally is mounted between the grip 17 and slide 14. The thumb safety 10 of the present invention is adapted for use with any style Model 1911 firearm, and can be provided both as an original component thumb safety for a Model 1911, or can be provided as an aftermarket replacement thumb safety for Model 1911's, including ambidextrously operable thumb safeties, without requiring reconfiguration or substantial reconstruction or modification of the firearm.

Figure 2A:
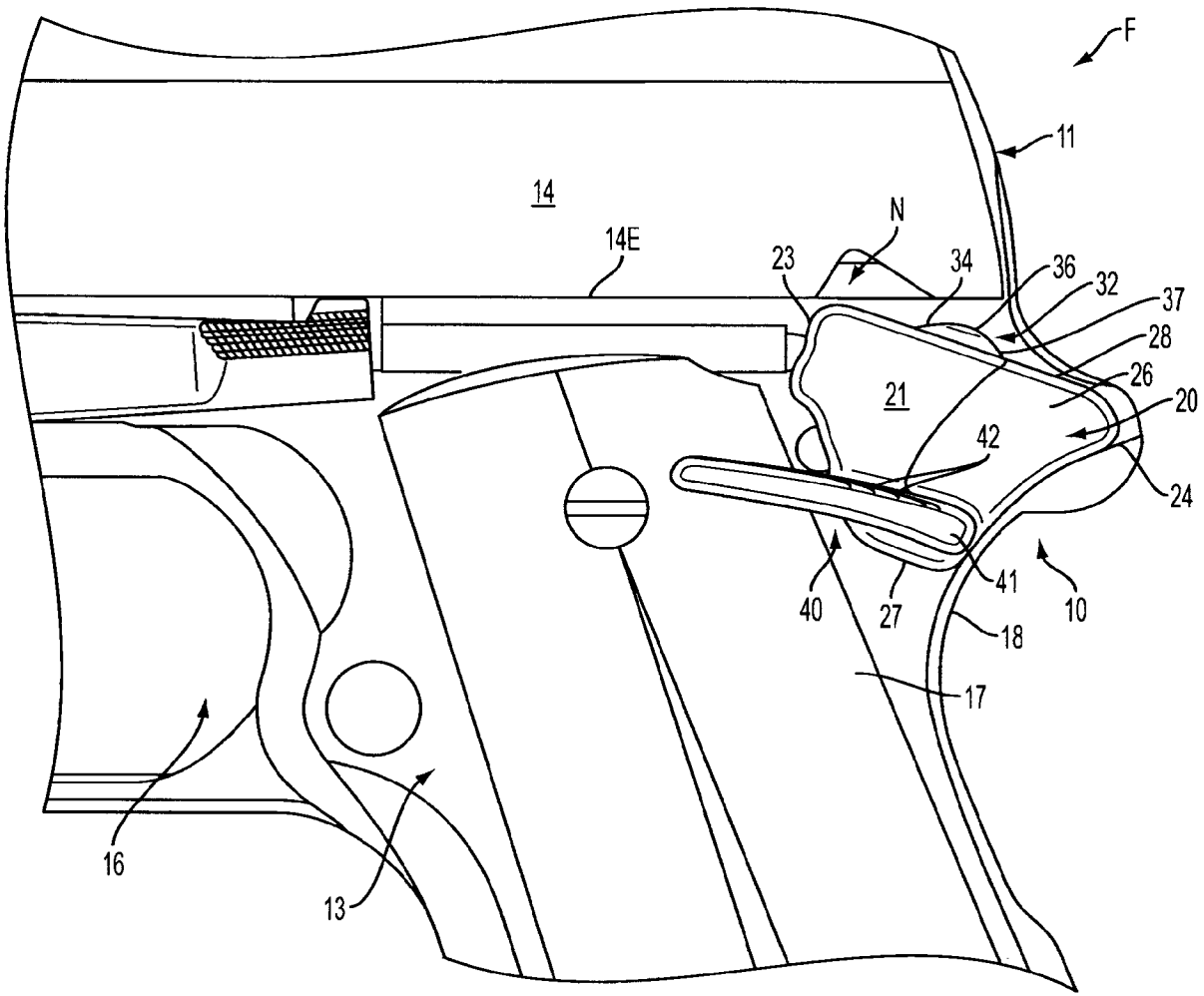
FIGS. 2A and 2B are side elevational views illustrating the thumb safety of the present invention in its non-engaging, fire position and its engaging, safe position.
Figure 2B:
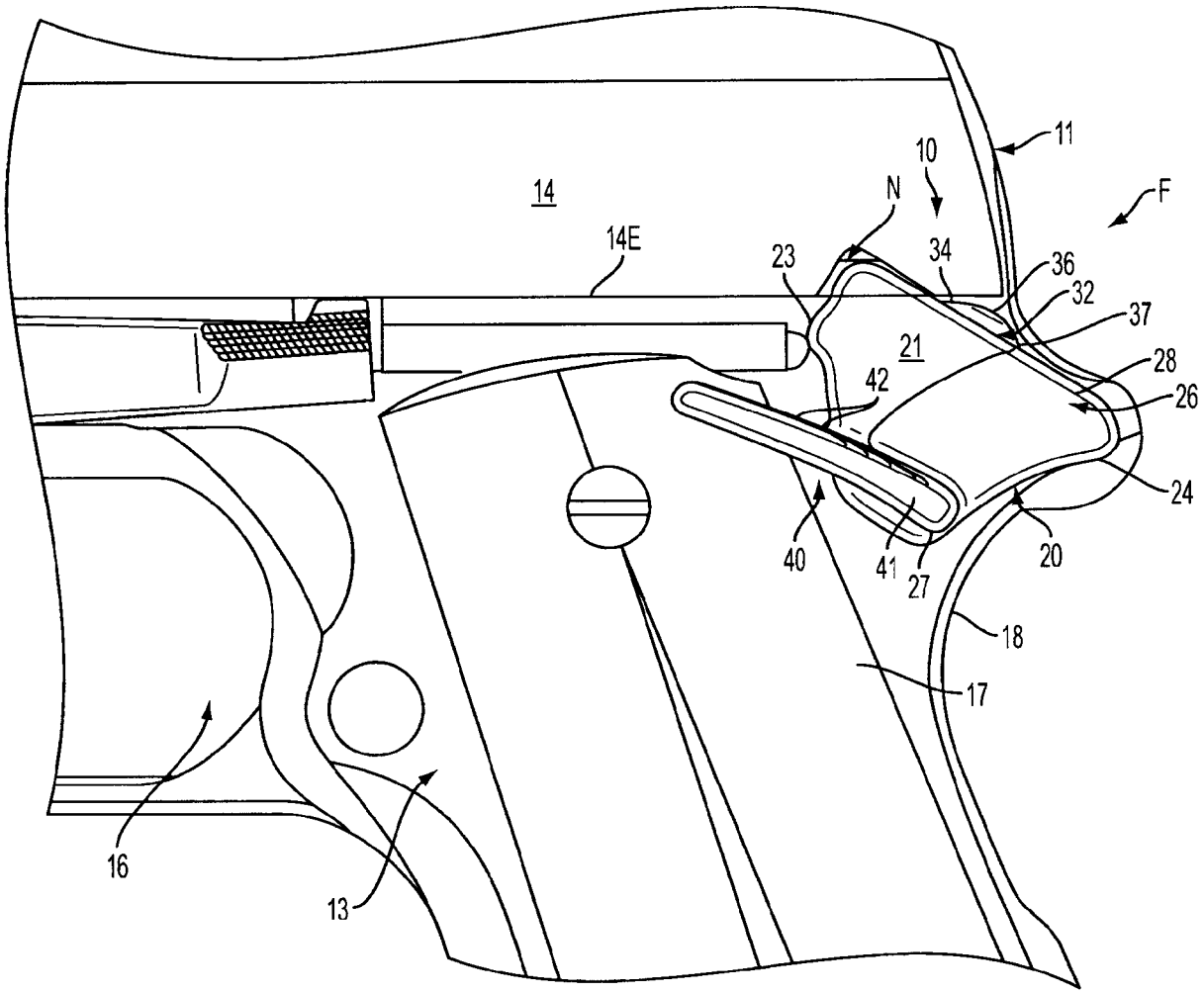
Figure 3:
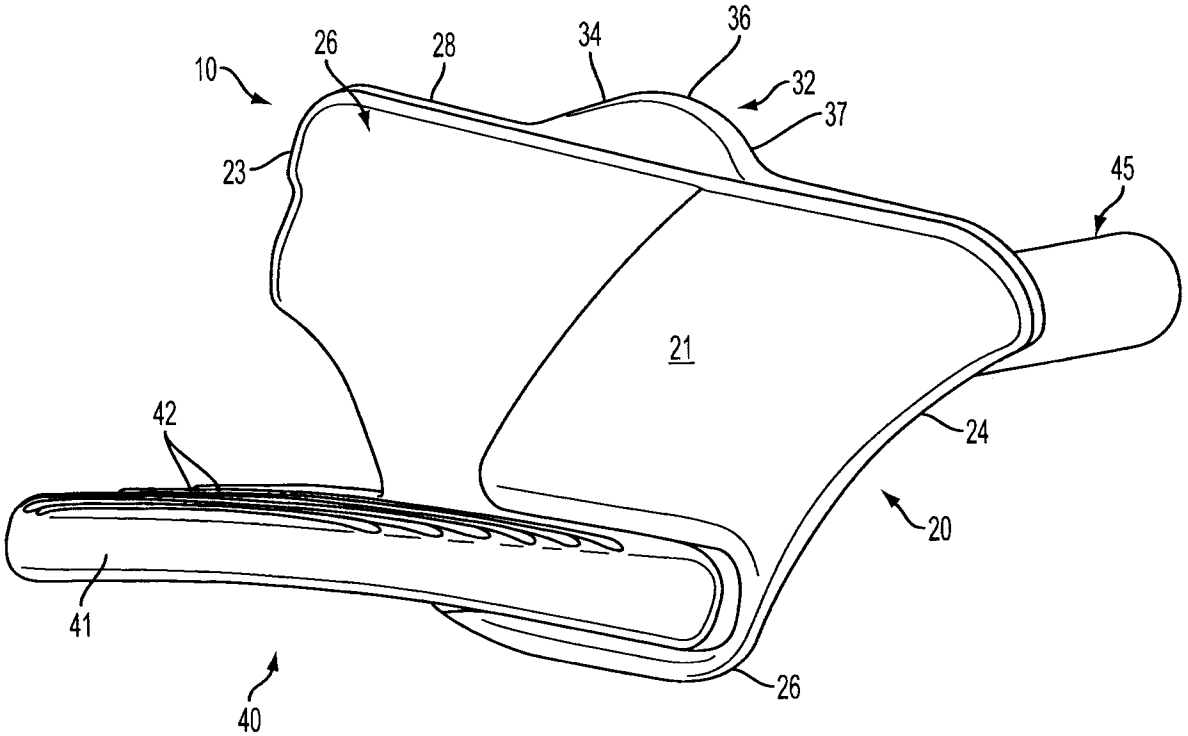
FIG. 3 is a perspective illustration of the thumb safety according to the principles of the present invention viewing the outer side thereof.
Figure 4:
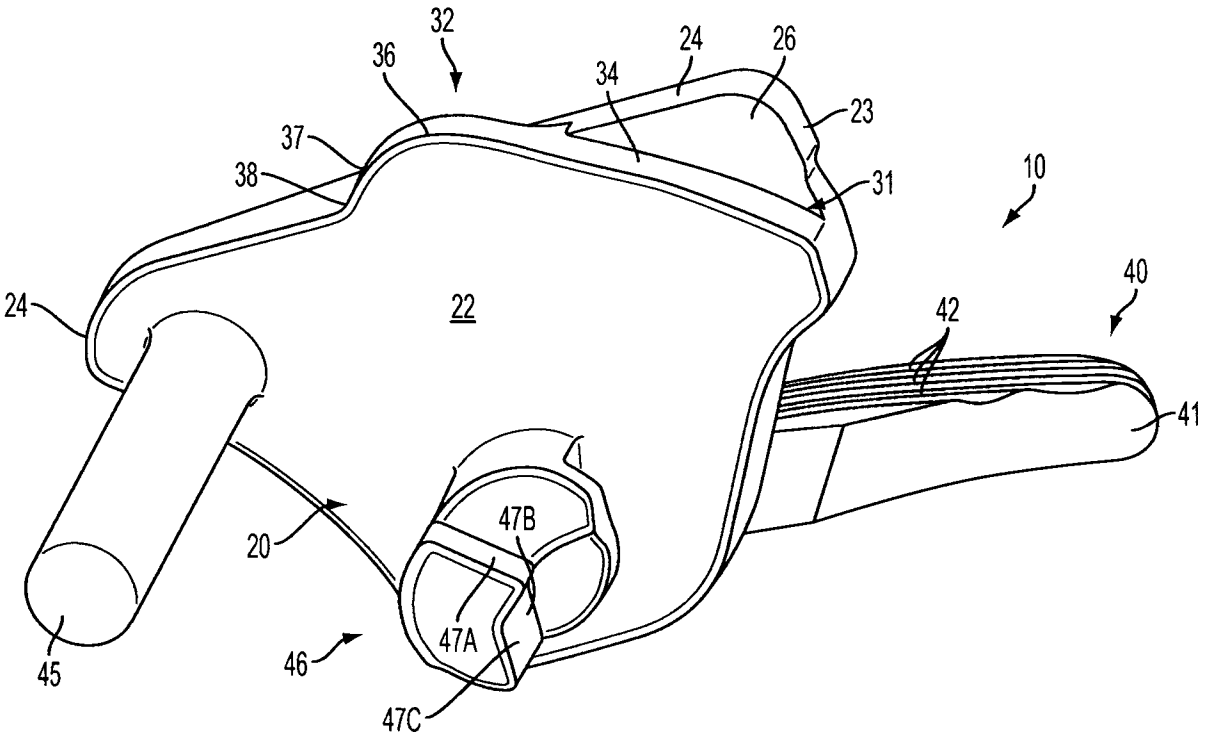
FIG. 4 is a perspective illustration of the thumb safety according to the principles of the present invention viewing the inner side thereof.

As shown in FIGS. 2-4, the thumb safety 10 generally includes a body 20, typically formed from a metal, such as steel, or other, similar material, and which includes an outer side surface portion 21 that faces outwardly from the frame 13 (FIGS. 2A-2B and 5A-5B) of the firearm F. The thumb safety body 20 also can have a finish or appearance that generally matches that of the firearm (i.e., being nickel plated, having bluing, or other surface treatments). An inner side surface portion 22 of the body (FIGS. 4 and 6A-6B) is adapted to engage and ride over or along the frame of the firearm, and can have a surface treatment or coating, such as a Teflon or plastic coating that will assist in movement of the thumb safety across the surface of the frame of the firearm between a first, non-engaging or "fire" position as shown in FIG. 2A, and a second, engaging or "safe" position as shown in FIG. 2B, without marring the finish of the firearm. The body 20 of the thumb safety 10 further generally will include front and rear or proximal and distal end edges 23 and 24 that slope inwardly and downwardly from a top portion 26 toward a bottom portion 27 of the body.

As shown in FIGS. 3-5B, the top portion 26 of the thumb safety body 20 generally will include an elongated, substantially flat upper surface section or portion 28 formed adjacent the outer side surface 21 of the body and which extends longitudinally from the first or front end 23 to the second or rear end 24 of the body. The top portion 26 of the body 20 further generally will include an inner section or surface 31 along which a blocking feature 32 is formed, as indicated in FIGS. 4-5B. This blocking feature generally can be formed as a cam projection, ridge, hump or other, similar raised feature, and extends from a first or lower front end 33 upwardly along an angled or sloped front surface 34 towards a peak 36 that projects above the flat upper surface 28 formed along the outer section of the top portion 26 as indicated in FIGS. 2A-3. The blocking feature 32 further includes a downwardly sloping rear surface 37 that merges into the flat upper surface 28 of the top portion as indicated at 38 in FIG. 3. The blocking feature thus defines a cam profile wherein when the thumb safety is raised to its engaging or safe position, the slide 14 (FIGS. 2B and 5B) of the firearm generally will engage and ride along the front surface 34 of the blocking feature 32, with a lower edge or surface 14E of the slide moving over and/or engaging or contacting the blocking feature, so as to secure the thumb safety in its safe position during operation of the firearm slide and prevent the thumb safety from over-rotating or otherwise becoming dislodged, as indicated in FIGS. 2B and 6A.

As further illustrated in FIGS. 1-3 and 6B, an engagement tab or member 40 generally will be formed along the outer side surface 21 of the body 20 of the thumb safety 10. This engagement tab generally can have a configuration substantially similar to that of a conventional thumb safety engaging tab, including an elongated body 41 that projects forwardly and which typically can have knurling, grooves or other surface features 42 formed therealong to facilitate gripping and engagement by a user's thumb for engaging and moving the thumb safety between its non-engaging or fire position and its is engaging or safe position as indicated in FIGS. 2A-2B.

As illustrated in FIGS. 3-4 and 6A, a post or pivot pin 45 generally will be formed or otherwise affixed to the inner side surface 22 of the thumb safety body 20, projecting into the frame 13 (FIG. 6A) of the handgun. The post 45 generally will be formed or mounted adjacent the upper surface 28 of the top portion 26 and the rear or second end 24 of the thumb safety body, and defines a pivot point about which the thumb safety is pivoted for movement between the fire and safe positions. A sear engaging member here, shown as a stub shaft 46 (FIG. 4), further is formed adjacent the bottom or lower portion 27 of the thumb safety body, and can be approximately centrally located between the first and second ends 23/24 of the body. While a generally cylindrical shaft is shown, other types or configurations of a sear-engaging member also can be used. The stub shaft 46 generally will include a series of angled engaging features or surfaces 47A-47C that are adapted to engage the sear of the firearm when the thumb safety is in its engaging or safe position so as to lock the sear in a position blocking the release and movement of the hammer of the firearm.

As illustrated in FIGS. 2A-2B, in use of the thumb safety 10 according to the principles of the present invention, the thumb safety will be pivoted from its lowered, non-engaging or fire position, upwardly to its raised, engaging or safe position, pivoting about its post 45 (FIGS. 3 and 6A) wherein the engaging surfaces of the shaft 46 are brought into engagement with the sear for locking the sear in a position blocking release and movement of the hammer. At the same time, the blocking feature 32 of the thumb safety will be moved into a position with its sloped forward surface 34 being brought substantially into alignment with the bottom edge 14E of the slide 14 of the firearm as shown in FIGS. 5B and 6B. In addition, as shown in FIGS. 1B and 5A, the profile of the outer side surface 21 of the body 20 of the thumb safety can substantially cover the notch N formed in the slide without actually engaging this notch.

As a result, actuation of the thumb safety 10 of the present invention locks the sear in its blocking or non-operative position for preventing actuation of the hammer of the firearm, while still enabling the slide of the firearm to be operated. The movement of the bottom edge of the slide over and along the forward edge of the blocking feature further retains the thumb safety in engagement with the sear as the slide is moved rearwardly. This enables the chamber of the firearm to be opened and any remaining round of ammunition therein removed, while at the same time the engagement of the bottom edge of the slide with the blocking feature of the thumb safety prevents the thumb safety from being over-rotated or substantially shifted or otherwise moved in a fashion that could dislodge the engagement surfaces 47A-47C (FIG. 4) of the stub shaft 46 of the thumb safety with the sear so as to maintain the safety in a safe position no matter the position of the slide of the firearm. Thus, the user can drop the magazine and operate the slide as needed to clear the chamber of the Model 1911 handgun with the thumb safety remaining in a safe, engaging position.

In addition, it further is possible to form the thumb safety 10 according to the principles of the present invention as an ambidextrous thumb safety as shown in FIGS. 6B-7. In such a configuration, the safety body 20 of the thumb safety 10 is generally mounted on a first or operating side of the firearm, while a secondary thumb safety body 100 can be mounted on the opposite, second or ambidextrous operating side of the firearm. Thumb safety body 100 can have a similar construction to that of the thumb safety body 20 (FIG. 1), or can be of a reduced size/configuration as shown in FIG. 7. The thumb safety body 100 generally will have a transverse post (not shown) extending through the firearm frame and engaging and interlocking with the post 45 of the opposite thumb safety body 20 (FIG. 6A).

As indicated in FIGS. 6B and 7, the thumb safety body 100 also generally can include a second engagement tab 101 similar to the first engagement tab 40 of the thumb safety 10, but does not necessarily engage the bottom edge/surface 14E of the slide on its side of the firearm. Instead, the thumb safety body 100 can be fixedly connected to and/or linked with thumb safety body 20 of the thumb safety 10 on the first or operating side of the firearm such that movement of the thumb safety body 100 causes a corresponding pivoting movement of thumb safety 10 into its engaging or blocking safe position engaging the bottom edge of the slide to place the firearm in a safe condition.

Alternatively, the thumb safety body 100 can have a configuration that is substantially the same as that of the thumb safety body 20, including a projection or similar blocking feature for engaging the slide of the firearm to lock the safety in an engaging position as discussed above. As a result, the secondary/ambidextrous thumb safety body 100 could be used for blocking over travel of the thumb safety as the slide passes thereover, while engagement of the stub shaft 46 (FIG. 4) of the thumb safety body 20 with the sear places the firearm in a "safe" position against firing. In another alternative embodiment, a blocking feature can be provided along both the thumb safety bodies 20 and 100 (FIG. 7) so that both sides of the thumb safety are engaged by the slide passing thereover as needed or desired and/or both thumb safety bodies can include a stub shaft or other mechanism for engaging the firearm sear and/or hammer to place the firearm in a "safe" condition.

Accordingly, the configuration of the blocking feature of the thumb safety of the present invention is adapted to engage a bottom edge of the firearm slide without interference with and without requiring a notch formed in the slide for operation, the thumb safety of the present invention can be used and incorporated, both as a single and an ambidextrous safety, into existing Model 1911-type firearms as an aftermarket or replacement part without requiring substantial modification or reconfiguration of the firearm frame and/or slide in order to utilize the thumb safety of the present invention. The configuration of the thumb safety further operates in conjunction with existing slide configurations or designs to assure that when in a safe position, the thumb safety will be prevented from over-rotating or becoming dislodged from engagement with the sear, thus enabling the hammer to move to a firing position even as the slide is moved between its rearward position for opening the chamber, and is released and returned to its forward position closing the chamber.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A semiautomatic pistol thumb safety coupled to a frame of a semiautomatic pistol adjacent a slide of the pistol, the thumb safety comprising: a safety body movably mounted to the frame of the pistol so that the safety body is movable between a fire position and a safe position, wherein actuation of the pistol is prevented, the safety body comprising an outer facing surface, an inner facing surface, a top portion, and a projection formed along the top portion of the safety body and including a sloping forward surface; wherein the slide of the pistol includes a length, with a lower edge extending along the length of the slide; and wherein the forward surface of the projection is moved substantially into alignment with the lower edge of the slide of the pistol when the safety body is moved to the safe position such that the slide is movable along the forward surface of the projection sufficient to clear a chamber of the pistol while engagement of the lower edge of the slide with the forward surface of the projection of the safety body maintains the safety body in the safe position such that the safety body cannot be moved from the safe position to the fire position unless the slide of the pistol is in battery.

2. The semiautomatic pistol thumb safety of claim 1, wherein the thumb safety further comprises a sear engaging member projecting from the inner facing surface of the safety body and including a series of engagement surfaces adapted to engage a sear of the pistol upon movement of the safety body to the safe position to render the sear non-operative.

3. The semiautomatic thumb safety of claim 1, wherein the thumb safety comprises an ambidextrously operable safety.

4. The semiautomatic thumb safety of claim 3, further comprising a first engagement tab formed along the outer facing side of the safety body, and a safety body having a second engagement tab mounted along an ambidextrous operating side of the pistol to enable ambidextrous operation of the thumb safety.

5. The semiautomatic pistol of claim 2, wherein the pistol comprises a model 1911 semiautomatic pistol.

6. A semiautomatic pistol comprising: a frame; a hammer, a sear, a barrel and a slide movable with respect to the frame and having a bottom edge extending along a length thereof; a fire control; and a safety movably coupled to the frame, the safety having a safety body with a sear engaging member projecting from the safety body toward the sear, and a blocking feature formed along a portion of the safety body adjacent the slide and defining a cam profile, including a cam surface, wherein the cam surface of the blocking feature is moved toward engagement with the bottom edge of the slide of the pistol when the safety body is moved from a first position to a second position whereby the sear engaging member engages to retain the sear in a non-operative position to prevent actuation of the pistol, and wherein the slide remains operable, being movable along the cam surface of the blocking feature while maintaining the safety body in the second position such that the safety body cannot be moved from the second position to the first position unless the slide of the pistol is in battery.

7. The semiautomatic pistol of claim 6, wherein the sear engaging feature comprises a rotatable stub shaft having a series of engagement surfaces to engage the sear.

8. The semiautomatic pistol of claim 6, wherein the pistol comprises a model 1911 semi-automatic pistol.

9. The semiautomatic pistol of claim 6, wherein actuation of the safety is enabled from an operating side and an ambidextrous operating side of the pistol.

10. The semiautomatic pistol of claim 9, wherein a second blocking feature is formed along the ambidextrous operating side of the pistol.

11. The semiautomatic pistol of claim 10, wherein the pistol comprises a model 1911 semi-automatic pistol.

12. A handgun, comprising:

a frame;

a barrel extending along a portion of the frame;

a slide movably mounted to the frame, the slide movable between a forward position and a rearward position and including a lower edge extending along the slide;

a hammer pivotally mounted to the frame;

a sear movable between a first position blocking movement of the hammer and a second position wherein the hammer is released;

a fire control connected to the sear and having a trigger for actuating firing of the handgun; and a thumb safety adjacent the slide and movable between fire and safe positions; the thumb safety comprising:

a safety body pivotally mounted to the frame;

a sear engaging member extending from the safety body and adapted to engage the sear and resist movement of the sear upon actuation of the trigger so as to block operation of the hammer when the thumb safety is moved to the safe position; and a cam projection having a sloped cam surface formed along the safety body, wherein when the thumb safety is in the safe position, the cam surface of the cam projection is aligned along the lower edge of the slide such that the slide can move over the cam projection between the forward and rearward positions while the movement of the safety body so as to move the thumb safety away from the safe position is blocked by engagement between the cam projection and the lower edge of the slide to prevent release of the hammer while still permitting operation of the slide of the handgun when the safety is in its the safe position and such that the safety body cannot be moved from the safe position to the fire position unless the slide of the handgun is in the forward position.

13. The handgun of claim 12, wherein actuation of the safety is enabled from an operating side or an ambidextrous operating side of the pistol.

14. The handgun of claim 12, further comprising a first engagement tab formed along the outer facing side of the safety body on a first side of the frame, and a second engagement tab mounted along a second side of the frame and connected to the safety body to enable ambidextrous operation of the thumb safety.

15. The handgun of claim 12, wherein the pistol comprises a model 1911 semi-automatic pistol.

16. The handgun of claim 12, wherein the thumb safety further comprises a sear engaging member projecting from the inner facing surface of the safety body and including an engagement surface adapted to engage the sear upon movement of the thumb safety to its safe position to retard movement of the sear as the slide is moved between its forward and rearward positions.

17. A handgun comprising a frame, a sear, a slide movable with respect to the frame and having a lower edge extending along a length of the slide; and an ambidextrous thumb safety adjacent the slide and movable between a fire position and a safe position engaging and blocking movement of the sear, the thumb safety comprising:

a first safety body located along an operating side of the frame;

a second safety body located along an ambidextrous operating side of the frame; and a blocking feature comprising a raised projection having a sloped forward surface formed along the second safety body;

wherein when the thumb safety is in the safe position, the forward surface of the blocking feature is moved to a position substantially aligned along the lower edge extending along the length of the slide such that the slide can move over the forward surface of the blocking feature between a forward position and a rearward position while movement of either safety body so as to move the thumb safety away from the safe position is substantially blocked by engagement between the blocking feature and the lower edge of the slide to prevent release of the sear while still permitting operation of the slide of the handgun when the thumb safety is in the safe position and such that the thumb safety cannot be moved from the safe position to the fire position unless the slide of the handgun is in the forward position.

18. The handgun of claim 17, wherein the thumb safety further comprises a sear engaging member projecting from the inner facing surface of the safety body and including an engagement surface adapted to engage the sear upon movement of the thumb safety to the safe position to retard movement of the sear as the slide is moved between the forward and rearward positions.

19. The handgun of claim 17, wherein the pistol comprises a model 1911 semi-automatic pistol.

* * * * *